US007096635B2

(12) United States Patent
Price et al.

(10) Patent No.: US 7,096,635 B2
(45) Date of Patent: Aug. 29, 2006

(54) MULTIUSE BLOCK AND RETAINING WALL

(75) Inventors: Raymond R. Price, Rochester, MN (US); Gerald P. Price, Rochester, MN (US)

(73) Assignee: Rockwood Retaining Walls, Inc., Rochester, MN (US)

( * ) Notice: Subject to any disclaimer, the term of this patent is extended or adjusted under 35 U.S.C. 154(b) by 102 days.

(21) Appl. No.: 10/674,731

(22) Filed: Sep. 30, 2003

(65) Prior Publication Data

US 2004/0118071 A1 Jun. 24, 2004

Related U.S. Application Data

(63) Continuation-in-part of application No. 09/798,210, filed on Mar. 2, 2001, now Pat. No. 6,651,401.

(51) Int. Cl.
*E04B 5/04* (2006.01)

(52) U.S. Cl. ..... 52/604; 52/570; 52/590.2; 52/592.1; 52/592.6; 405/258; 405/284; 405/286

(58) Field of Classification Search ..... 52/169.1, 52/169.2, 283, 284, 286, 590.6, 592.6, 603, 52/607; 405/262, 284, 286
See application file for complete search history.

(56) References Cited

U.S. PATENT DOCUMENTS 4,123,881 A * 11/1978 Muse ..... 52/100
5,161,918 A 11/1992 Hodel
5,490,363 A 2/1996 Woolford
5,525,017 A 6/1996 Asada
5,601,384 A 2/1997 Dawson
5,641,042 A 6/1997 Maeda
5,653,558 A 8/1997 Price
5,820,304 A 10/1998 Sorheim et al.
5,941,042 A * 8/1999 Dueck ..... 52/604
5,951,210 A 9/1999 Maguire et al.
6,082,933 A * 7/2000 Maguire et al. ..... 405/286
6,113,318 A 9/2000 Guth
6,149,352 A 11/2000 MacDonald
6,168,353 B1 1/2001 Price
6,168,354 B1 1/2001 Martin et al.
6,318,934 B1 11/2001 Borgersen et al.
6,338,597 B1 1/2002 Rainey (Continued)

FOREIGN PATENT DOCUMENTS

JP 54107106 7/1979

(Continued)

OTHER PUBLICATIONS

"Classic" product literature, Rockwood Retaining Walls 1997.

(Continued)

*Primary Examiner*—Carl D. Friedman
*Assistant Examiner*—Yvonne M. Horton
(74) *Attorney, Agent, or Firm*—Patterson, Thuente, Skaar & Christensen, P.A.

(57) ABSTRACT

A retaining wall with a series of differently sized, preformed blocks. Each block includes a projection and a recess, with the projection and recess arranged and configured so that each projection effectively engages a recess in an adjacent course to connect and align adjacent courses in registry. Retaining walls made of horizontal blocks may be stacked in columnar fashion or running bond fashion. The location of the indexing surface on a projection relative to the viewable surface of the block may be varied to enable adjacent courses to be coplanar or tiered in a variety of predetermined offset distances.

29 Claims, 4 Drawing Sheets

U.S. PATENT DOCUMENTS

| | | | | |
|---|---|---|---|---|
| 6,443,663 | B1 | 9/2002 | Scales et al. | |
| 6,447,211 | B1 | 9/2002 | Scales et al. | |
| 6,464,432 | B1 * | 10/2002 | Shaw | 405/286 |
| 6,523,317 | B1 * | 2/2003 | Bott et al. | 52/609 |
| 6,641,334 | B1 * | 11/2003 | Woolford | 405/284 |
| 6,651,401 | B1 * | 11/2003 | Price et al. | 52/604 |
| 6,715,965 | B1 * | 4/2004 | Manthei et al. | 405/284 |

FOREIGN PATENT DOCUMENTS

| | | |
|---|---|---|
| JP | 54107105 | 8/1979 |
| JP | 59-167842 | 11/1984 |
| NZ | 92167 | 7/1948 |
| NZ | 151299 | 9/1969 |
| NZ | 218330 | 9/1989 |

OTHER PUBLICATIONS

"Ashlar Blend Rataining Wall" product literature, Allan Block Corporation, 1997.

"Garden Rockery" retaining wall system product literature, Pacific Precast Products, Ltd. 1998.

ROCKWOOD, *The on-piece easy to use system, Installation & Design Manual*, undated, 19 pages.

Rockwood Retaining Walls, Inc., *In the Classic Style*, undated, 12 pages.

* cited by examiner

MULTIUSE BLOCK AND RETAINING WALL

CROSS REFERENCE TO PRIOR APPLICATION

This application is a continuation-in-part of prior application Ser. No. 09/798,210, filed Mar. 2, 2001, now U.S. Pat. No. 6,651,401 entitled RETAINING WALL AND METHOD OF WALL CONSTRUCTION.

FIELD OF THE INVENTION

This invention relates generally to the construction of retaining walls used in landscaping applications where such walls are used to provide lateral support between differing ground levels. More particularly, the present invention relates to a retaining wall that uses a series of differently sized, pre-formed horizontal and vertical blocks that operatively connect with each other along adjacent courses to resist pressure exerted against the wall by retained back-fill material and ground water.

BACKGROUND OF THE INVENTION

Retaining walls are widely used in a variety of landscaping applications. Typically, they are used to maximize or create level areas and also to reduce erosion and slumping. They may also be used in a purely decorative manner. In the past, retaining wall construction was labor intensive and often required the skills of trained tradespeople such as masons and carpenters. More recently, retaining wall construction has become significantly simplified with the introduction of self-aligning, modular, molded blocks of concrete that may be stacked in courses without the use of mortar or extensive training. With these types of blocks, it is possible to erect a retaining wall quickly and economically, and the finished product creates the impression and appearance of a conventional block and mortar retaining wall. The feature that allows such blocks to be so easily and precisely assembled is the interconnection between adjacent courses of blocks. Typically, each block will include a projection and a recess located at oppositely facing surfaces, such as a top surface and a bottom surface, for example. The projection and recess are complimentarily shaped, with the projection protruding beyond the bottom surface of the block and with the recess extending inwardly from the top surface of the block. In use, a projection of a first block is received within the recess of a second block to interconnect and position the blocks adjacent each other in a predetermined relation. With a plurality of blocks, such interconnections make it possible to lay courses of blocks in an accurate and expedient manner. Moreover, such an assembled retaining wall is able to resist lateral forces exerted by the material being retained and reduce bowing. Blocks having these interconnections are usually the same size and may be assembled in a coplanar arrangement in only a simple, running bond pattern. In a variation of the aforementioned blocks, the projection and recess may be arranged so that adjacent courses are offset a predetermined amount. With this type of block, each successive course may be offset from the preceding course by the same amount so that the assembled wall is skewed at a predetermined angle from the vertical. These blocks also have the same dimensions to enable them to set in only a simple, running bond pattern.

A recent development in mortarless retaining walls has been the advent of blended pattern retaining walls. These walls differ from the aforementioned walls in that the preformed blocks used to construct a retaining wall are differently sized. This feature allows retaining walls to be assembled in a variety of patterns and bonds. Usually, these types of preformed blocks are horizontally and vertically oriented and have dimensions that are based upon an incremental unit such as the thickness of a horizontal, preformed block. For example, the thickness of a horizontal block is one increment and the height of a vertical block is two increments. With these types of preformed blocks, it is possible to construct a retaining wall with no discernable courses. A drawback with such a retaining wall is that setbacks are not possible and the assembled retaining wall must be substantially vertical. Alternatively, a retaining wall may be arranged in thick courses, and the blocks within these thick courses may be randomly arranged. For example, a course may be two incremental units high within which the differently dimensioned preformed blocks are arranged. Or, the course may be three incremental units high within which the differently dimensioned preformed blocks are arranged. There are several drawbacks with this type of wall. One drawback is that the vertical blocks dictate the height of the course. Thus, if vertical blocks are used, each entire course must be coplanar and all of the blocks must lie in the same plane. Otherwise, the projections of blocks in one course would not be able to be received within the recesses in blocks of another course, and the interconnection would be defeated. Another drawback with such this type of wall is that the number of arrangements available within each course is limited, and a truly random arrangement is not possible.

BRIEF SUMMARY OF THE INVENTION

The present invention comprises a plurality of horizontally elongated and vertically elongated, preformed blocks that may be assembled to form a retaining wall. Each horizontal preformed block includes a front member and a rear member connected to each other by a web, opposing sides, a top portion and a bottom portion. The horizontal blocks may be formed in a series of predetermined incremental thicknesses whose additive thickness is equal to the height of the vertical block. For example, the horizontal blocks may have incremental thicknesses of one, two and three units, while the vertical preformed block is three units tall. Thus, the horizontal blocks may be stacked in whatever units which, when added together, would be three units tall.

The front member of each horizontal block includes a rearwardly facing portion having stop surfaces that are aligned with each other and are used to operatively connect adjacent courses of blocks. Each horizontal block also includes a recess and a projection located at oppositely facing support surfaces, respectively. Preferably, the recess is located at the top of each block and extends downwardly with respect to the top support surface of each block forming a through slot with open ends in spaced relation to the front member of each block. An important feature of the recess in these blocks is that the recess includes a stop surface that is in alignment with stop surfaces of the rearwardly facing portion of the front member of each block. Together, these stop surfaces form a single stop surface that extends substantially along the length of each horizontal block. This greatly increases the utility of each block because it allows the blocks of an adjacent upper course of blocks to be slidingly positioned with respect to a lower course of blocks as the retaining wall is being constructed. This adds to the number of possible arrangements of blocks and helps one construct a stronger retaining wall because aligned vertical joints between adjacent courses may be easily avoided.

The projection on the horizontal block extends downwardly with respect to the bottom surface of each block. Preferably, the width of the projection is substantially equal to the width of web that connects the front and rear members together. Each projection includes an indexing surface that is configured to operatively contact a stop surface of an adjacent course of blocks.

Each vertical preformed block includes a front member and a rear member connected to each other by upper and lower webs, opposing sides, a top portion and a bottom portion. The front member of each vertical block includes a rearwardly facing portion having a stop surface. Each vertical block also includes a recess and a projection located at oppositely facing support surfaces, respectively. Preferably, the recess is located at the top of each block and extends downwardly with respect to the top support surface of each vertical block forming a through slot with open ends in spaced relation to the front member of each block. The recess in these blocks includes a stop surface that is coincident with the stop surface of the front member, and, as with the horizontal blocks, the stop surface extends substantially along the width of each vertical block.

As with the horizontal block, the projection on the vertical block extends downwardly with respect to the bottom surface of each block, and preferably its width is coincident with the width of the vertical block. Each projection of the vertical block also includes an indexing surface that is configured to operatively contact the stop surface of an adjacent course of blocks.

Another important feature of the aforementioned blocks relates to the operative connections that occur between the projections and recesses of adjacent courses of blocks. This is achieved by using blocks that have a stop surface which is fixed relative to a common feature of the blocks, such as the viewable surface, and blocks which have indexing surfaces located at a series of predetermined distances from a common feature of the blocks, also such as the viewable surface. For example, to construct a coplanar wall, one would select those blocks where the indexing surfaces are at a first predetermined position. Alternatively, to construct a wall that tilts at a slight angle with respect to the vertical, a different set of blocks with indexing surfaces located at a second predetermined position would be used. And, to construct a wall which tilts at a greater angle with respect to the vertical, yet another set of blocks with indexing surfaces located at a third predetermined position would be used, and-so-on. This feature may be combined with the other features discussed above to produce a myriad of retaining wall configurations that may include combinations with different setbacks and/or no setbacks.

An object of the present invention is to provide a retaining wall that may be assembled without the use of mortar.

Another object of the present invention is to increase the number of arrangements possible between adjacent blocks in a retaining wall.

Yet another object of the present invention is to reduce undesired lateral movement between adjacent courses in a retaining wall.

A feature of the present invention is that vertical, preformed blocks have a height that is equivalent to two or more stacked horizontal preformed blocks.

Another feature of the present invention is that the horizontal, preformed blocks may have the same thickness or may have complimentary thickness whose additive thickness is equal to the height of vertical, preformed blocks.

Another feature of the present invention is that the courses of blocks may be assembled in a coplanar or one of several predetermined offset relations.

An advantage of the present invention is that the use of differently sized and oriented preformed blocks permits a retaining wall to be configured into a myriad of configurations.

Another advantage of the present invention is that each course presents a substantially contiguous, aligned stop surface against which indexing surfaces of projections of an adjacent course of blocks are positioned.

Additional objects, advantages and features of the invention will be set forth in part in the description which follows, and in part will become apparent to those skilled in the art upon examination of the following or may be learned by practice of the invention. The objects and advantages of the invention may be realized and attained by means of the instrumentalities and combination particularly pointed out in the appended claims.

DESCRIPTION OF THE PREFERRED EMBODIMENT

Figure 1:
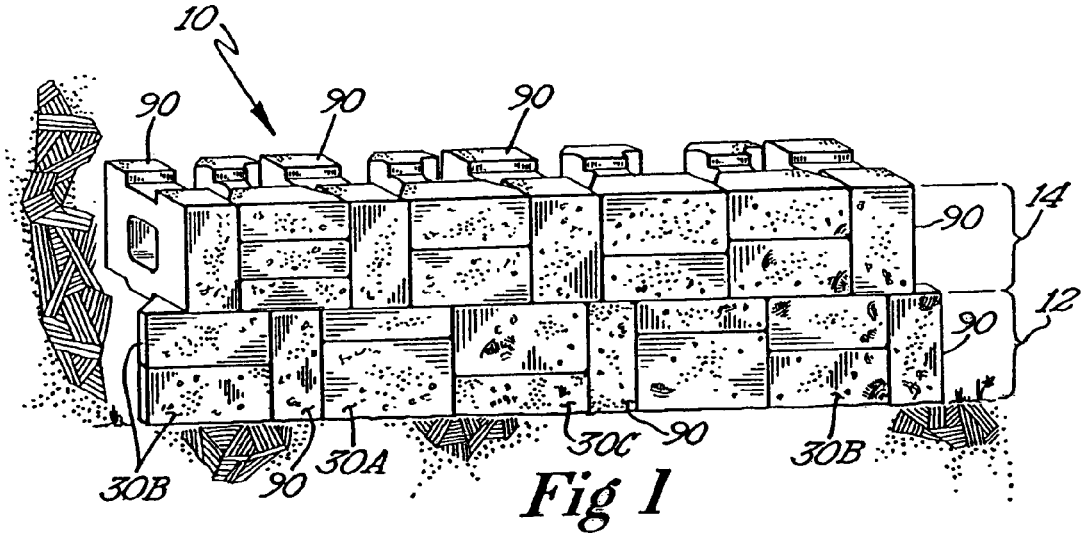
FIG. 1 is a front, perspective, partial view of one embodiment of a completed, coplanar retaining wall of the present invention.

With reference to the drawings, FIG. 1 shows one embodiment of a retaining wall 10 comprising a plurality of horizontally and vertically oriented preformed blocks 30A, 30B, 30C, and 90 of the present invention. As will be discussed later in greater detail, the horizontal, preformed blocks 30A, 30B, and 30C may be formed in different incremental thickness, and are combinable so that their total thickness is equal to the height of the vertical, preformed blocks 90. As shown in FIG. 1, the horizontal, preformed blocks 30A, 30B, 30C may be selected and stacked in combinations of twos and threes. That is, block 30A and block 30C, two blocks of 30B, and three blocks of 30C. It will be understood, that each course of blocks may be defined by the height of the vertical blocks 90. Thus, beginning with the lower left segment of the wall 10, the first course 12 comprises two stacked 30A blocks, a vertical block 90, two stacked 30A and 30C blocks, two stacked 30C and 30A blocks, a vertical block 90 etc. The second course 14 is similarly constructed, beginning from the upper left segment of the wall 10 with a vertical block 90, three stacked 30C blocks, a vertical block 90, and so on. Note that the first and second courses 12, 14 are shifted linearly with respect to each other along their top and bottom surfaces, respectively, by a distance of about one-half the width of a vertical block 90. This configuration assures that vertical joints do not span adjacent courses. This not only strengthens the retaining wall but also allows the blocks to be arranged in a more random fashion. Note that even though the first and second courses 12, 14 are arranged to present a more or less planar viewable surface, an extremely large number of combinations of blocks are possible, limited only by the imagination of a designer or an assembler. As a further note, while the viewable surfaces 34, 94 of the front members 32, 92 of the horizontal and vertical blocks 30, 90, respectively, are depicted as being roughened, it is understood that blocks having other surface finishes and textures may be used.

Figure 2:
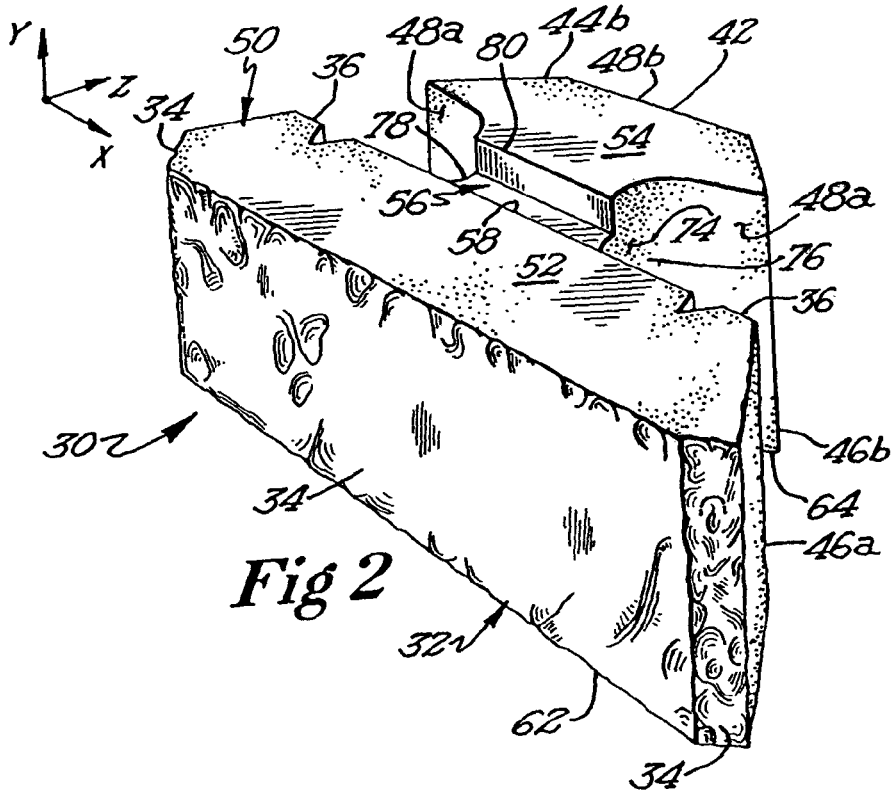
FIG. 2 is a perspective view of an embodiment of the preformed blocks of the present invention taken from a position in front of and above the block.
Figure 3:
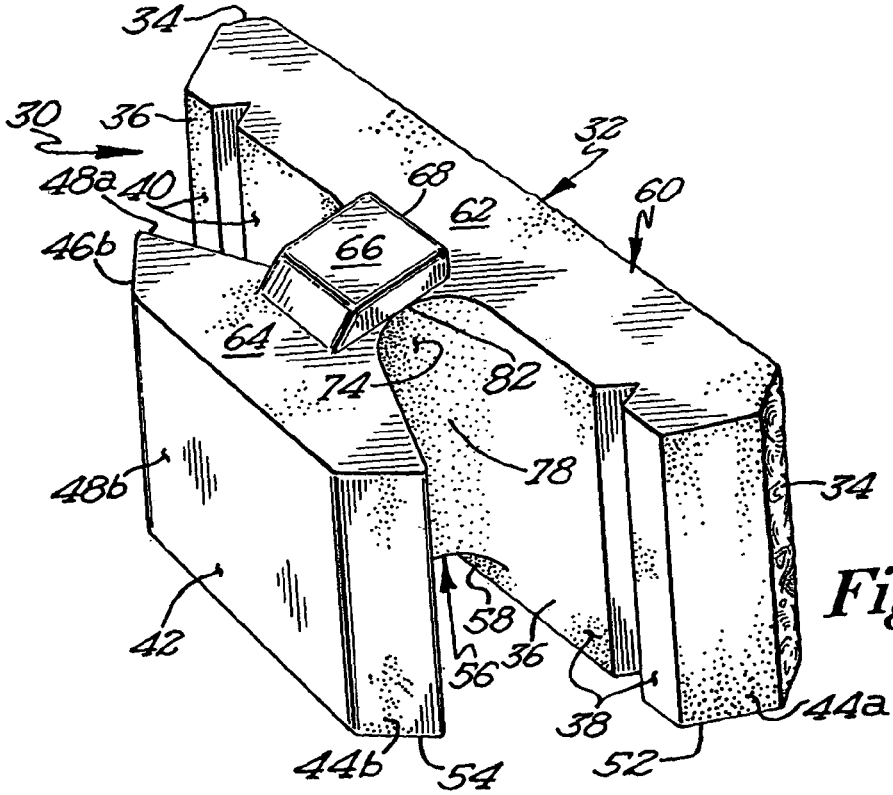
FIG. 3 is another perspective view of the block of FIG. 2 taken from the same position, with the block in an inverted and outwardly facing orientation.

Referring now to FIGS. 2 and 3, each horizontal, preformed block 30 includes a front member 32, a rear member 42, opposing sides 44*a*, 46*a*, a top 50 and a bottom 60. The front member 32 includes a viewable surface 34 having a predetermined texture and finish. As mentioned above, it is understood that the viewable surface 34 may be provided with other textures and finishes, as desired. The front member 32 also includes a rearwardly facing back surface 36 in spaced relation from the viewable surface 34, with the back surface 36 including stop surfaces 38, 40. As will be discussed later, the stop surfaces 38, 40 enable adjacent courses of blocks to be operatively connected to each other.

For purposes of this application, the term operatively connect is understood mean that movement between adjacent courses of blocks in response to pressure exerted by retained material and water is resisted by complimentary confronting surfaces in adjacent courses of blocks.

Referring again to FIGS. 2 and 3, each horizontal block includes a rear member 42 having opposing sides 44*b*, 46*b*, interior surfaces 48*a*, an exterior surface 48*b*, a top 50, and a bottom 60. Rear member 42 is held in spaced relation from the front member 32 by a web 74. The web 74 includes opposing sides 76, 78, an upper surface 80 and a lower surface 82. With regard to FIG. 2, the top 50 of the block includes top support surfaces 52, 54 that are configured to operatively contact bottom support surfaces 62, 64 of overlying courses of blocks (See, FIGS. 6–9). The top 50 of the block 30 also includes a recess 56 that extends downwardly from the upper surface 80 of the web 74, and downwardly relative to the top support surfaces 52, 54. The recess 56 includes a stop surface 58 that is in alignment with the stop surfaces 38, 40 of the back surface 36 of the block 30. Together, these stop surfaces 38, 40 and 56, extend substantially along the entire width of the block 30 and greatly expand the operative connection range available to a practitioner. Preferably, the stop surfaces 38, 40, and 58 will be located a certain, fixed distance measured from a feature common to all of the blocks, such as the viewable surface 34. The bottom 60 of the block 30 includes corresponding bottom support surfaces 62, 64 that are configured to operatively contact top support surfaces of underlying courses of blocks (See, FIGS. 6–9). The bottom 60 of the block 30 includes a projection 66 that constitutes the other part of the operative connection between adjacent courses of blocks. The projection 66 extends downwardly from the lower surface 82 of the web 74 and downwardly relative to the bottom support surfaces 62, 64. The projection 66 includes an indexing surface 68 that is configured to operatively contact the stop surface(s) of an adjacent course of blocks. As will be described later in greater detail, the indexing surface 68 differs from the stop surfaces in that there are a plurality of fixed distances measured from a feature common to all of the blocks, such as the viewable surface 34, at which an indexing surface 68 may be located.

As described previously, and as shown in the FIG. 1, the thickness of block 30 may be formed incrementally. That is, the horizontal blocks may be formed in such a manner to allow stacked blocks 30 to be equal in height to a vertical block 90. And, while the incremental units chosen may be quite small, the preferred incremental thicknesses are approximately one-third, one-half, and two-thirds of the height of a vertical block 90. For example, the horizontal blocks may have incremental thicknesses of one, two and three units, while the vertical preformed block is three units tall. Thus, the horizontal blocks may be stacked in whatever units which, when added together, would be three units tall.

Figure 4:
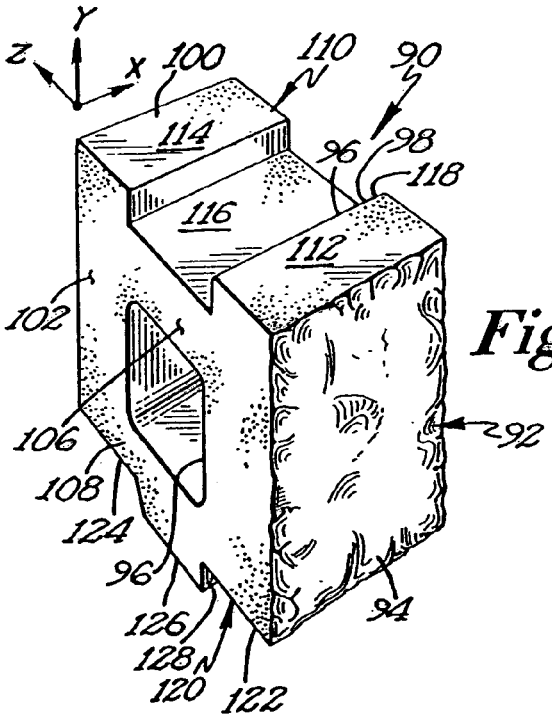
FIG. 4 is a perspective view of another embodiment of the preformed blocks of the present invention taken from a position in front of and above the block.
Figure 5:
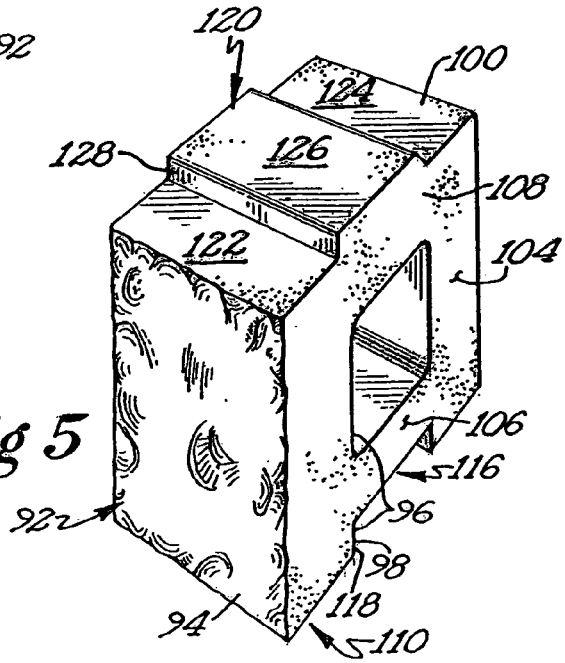
FIG. 5 is an inverted perspective view of the block of FIG. 4 taken from a position in front of and above the block.

Referring now to FIGS. 4 and 5, each vertical, preformed block 90 includes a front member 92, a rear member 100, opposing sides 102, 104, a top 110 and a bottom 120. The front member 92 includes a viewable surface 94 having a predetermined texture and finish. However, it is understood that the viewable surface 94 may be provided with other textures and finishes, as desired. The front member 92 also includes a rearwardly facing portion 96 in spaced relation from the viewable surface 94, with the rearwardly facing portion 96 including a stop surface 98. As will be discussed later, the stop surface 98 enables adjacent courses of blocks to be operatively connected to each other.

For purposes of this application, the term operatively connect is understood mean that movement between adjacent courses of blocks in response to pressure exerted by retained material and water is resisted by complimentary confronting surfaces in adjacent courses of blocks.

Referring again to FIGS. 4 and 5, each vertical block 90 includes a rear member 100 that is held in spaced relation from the front member 92 by upper and lower webs 106, 108, respectively, and opposing sides 102, 104. With regard to FIG. 4, the top 110 of the block 90 includes top support surfaces 112, 114 that are configured to operatively contact bottom support surfaces of overlying courses of blocks (See, FIGS. 6–9). The top 110 of the block 90 also includes a recess 116 that extends downwardly relative to the top support surfaces 112, 114 and which includes a stop surface 118 that is coincident with the stop surface 98 of the rearwardly facing portion 96. As can be seen in FIGS. 4 and 5, the stop surface 98 (or alternatively 118 in this particular instance) extends along the entire width of the block 90. Preferably, the stop surface 98 will be located a certain, fixed distance measured from a feature common to all of the blocks, such as the viewable surface 94. The bottom 120 of the block 90 includes corresponding bottom support surfaces 122, 124 that are configured to operatively contact top support surfaces of underlying courses of blocks (See, FIGS. 6–9). The bottom 120 of the block 90 includes a projection 126 that constitutes the other part of the operative connection between adjacent courses of blocks. The projection 126 also extends downwardly relative to the bottom support surfaces 122, 124 and includes an indexing surface 128 that is configured to operatively contact the stop surface(s) of an adjacent course of blocks. As will be described later in greater detail, the indexing surface 128 differs from the stop surface in that there are a plurality of fixed distances measured from a feature common to all of the blocks, such as the viewable surface 94, at which an indexing surface 128 may be located.

As described previously, and as shown in the FIG. 1, the height of the vertical block 90 is based upon an incremental unit, such as the thickness of the thinnest horizontal block.

Figure 6:
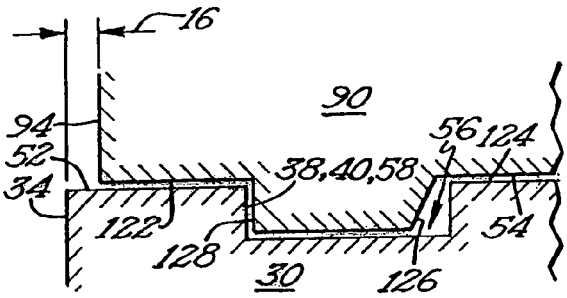
FIG. 6 a partial side view illustrating a first setback and the interface between adjacent courses of blocks.
Figure 7:
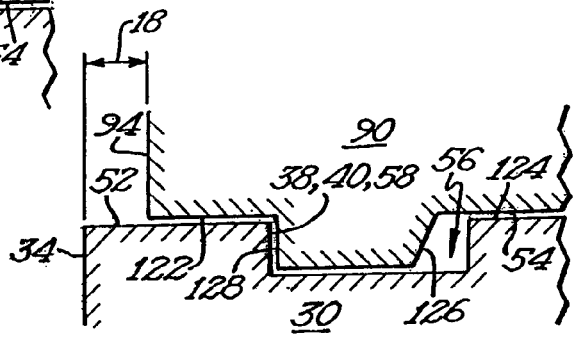
FIG. 7 is a partial side view illustrating a second setback and the interface between adjacent courses of blocks.
Figure 8:
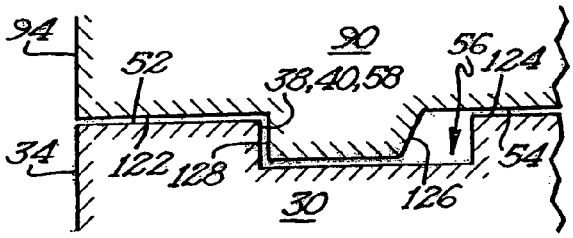
FIG. 8 is a partial side view illustrating coplanar alignment and the interface between adjacent courses of blocks.

Before describing FIGS. 6, 7 and 8 in detail, it should be understood that the operative connection between vertical and horizontal blocks is essentially the same and the blocks depicted in FIGS. 6, 7, and 8 could be any combination of horizontal and vertical blocks. For purposes of simplification, however, the blocks shown in FIGS. 6–9 will be identified and described with the convention that each upper course block is a vertical block 90 and each lower course block is a horizontal block 30. Using the aforementioned convention, the operative connections between adjacent courses of vertical blocks as depicted in FIGS. 6, 7 and 8, will now be discussed.

FIG. 6 illustrates an operative connection in which a viewable surface 94 of vertical block 90 is offset from a viewable surface 34 of a horizontal block 30 by a first predetermined distance 16. As can be seen, the bottom support surfaces 122, 124 of the vertical block 90 are in substantial contact with the top support surfaces 52, 54 of the horizontal block 30, and the indexing surface 128 of the projection 126 of vertical block 90 is in substantial contact with the stop surface (38, 40, 58) of the back surface 36 and/or recess 56 of the horizontal block 30.

FIG. 7 illustrates an operative connection in which a viewable surface 94 of vertical block 90 is offset from a viewable surface 34 of a horizontal block 30 by a second predetermined distance 18. And, FIG. 8 illustrates an operative connection in which a viewable surface 94 of vertical block 90 is coplanar with a viewable surface 34 of a horizontal block 30. It should be noted that the recesses depicted in the aforementioned FIG. 6, 7, and 8 are configured to be sufficiently large enough to accommodate projections of varying sizes, and the only surfaces at which a contacting relation must be established in order to operatively connect or restrain adjacent courses of blocks so that they are able to resist forces exerted by retained material are the stop and indexing surfaces of the recesses and projections, respectively.

Figure 9:
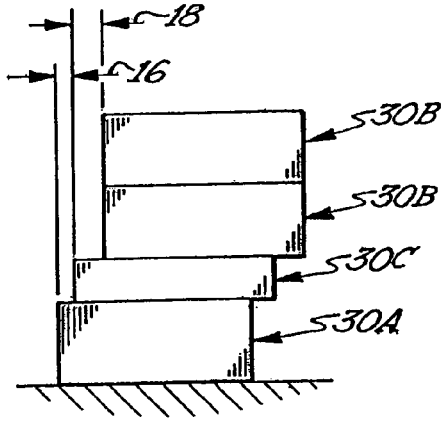
FIG. 9 is a side elevational view of an embodiment illustrating various setbacks which are possible with the blocks of the present invention.

FIG. 9 illustrates an embodiment in which a plurality of horizontal blocks having different incremental thicknesses are operatively connected to each other in a plurality of stacked relations, or groups. As described previously, and as shown in the FIGS. 1 and 9, the thickness of horizontal block 30 may be formed incrementally to allow stacked horizontal blocks 30 to be equal in height to a vertical block 90. For example, a preferred horizontal block 30 incremental thickness of one, two and three units with approximately one-third, one-half, and two-thirds of the height of a vertical block 90 is shown in FIG. 9 by horizontal blocks 30C, 30B and 30C respectively.

Further shown in FIG. 9 are the viewable surfaces of the two lowermost horizontal blocks 30A, 30C that are offset from each other by a first predetermined distance 16. The viewable surfaces of the second and third horizontal blocks 30C, 30B are offset from each other by a second predetermined distance 18, and the viewable surfaces of the two uppermost horizontal blocks 30B, 30B are coplanar.

Figure 10:
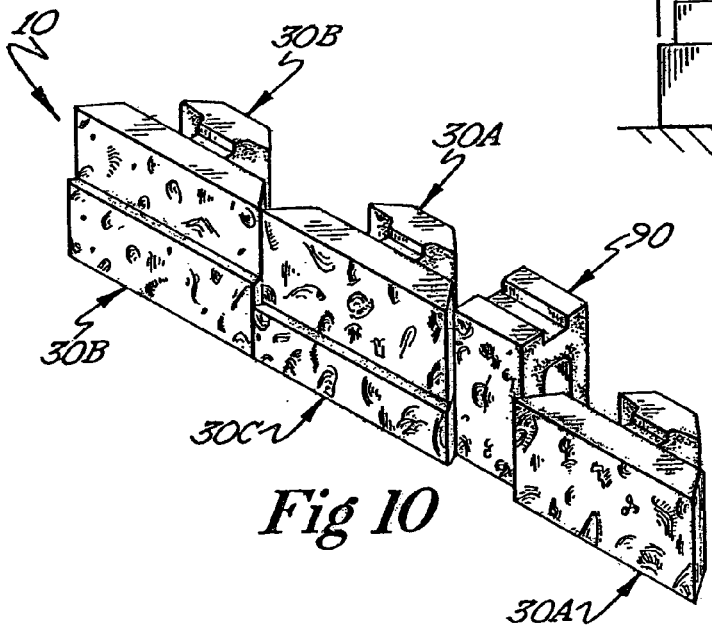
FIG. 10 is a front, perspective, partial view of an embodiment of a completed, variable setback retaining wall of the present invention.

FIG. 10 illustrates an embodiment in which a retaining wall includes a plurality of blocks, some of which have been setback. Beginning with left side, there are two horizontal blocks 30B, 30B that are stacked one above the other in a group, with the upper block 30B set back from the lower block 30B a predetermined distance. Next, there are two horizontal blocks 30A, 30C that are stacked one above the other in another group, with the upper block 30A set back from the lower block 30A a predetermined distance. Next, there is a vertical block 90 that is set back a predetermined distance. And finally, there is a horizontal block 30A. Thus, the lowermost horizontal blocks of this embodiment are in alignment with each other, while the uppermost horizontal blocks and the vertical blocks are in alignment with each other. Note that the course as depicted is equal to the height of the vertical block. More importantly, with this invention it is possible to have setbacks between adjacent stacked and/or vertical blocks within each course. Thus the possible arrangement of blocks is greatly increased to provide a nearly limitless variety of configurations available to a practitioner.

Figure 11:
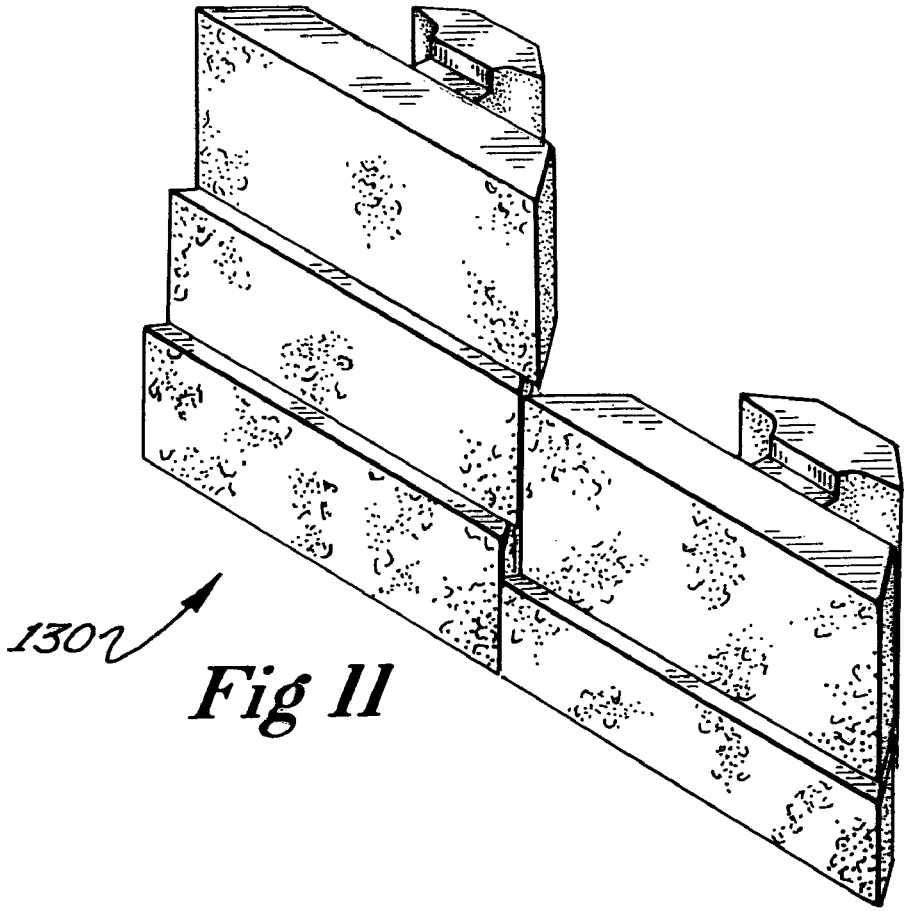
FIG. 11 is a front perspective view of an embodiment of a retaining wall with horizontal blocks stacked one above the other in a columnar fashion in accordance with the present invention.

Shown in FIG. 11 is a retaining wall embodiment where a plurality of horizontal preformed blocks 30 are stacked one above the other in a columnar fashion 130. One block 30 in one course is positioned directly over another block 30 in an underlying course. Blocks 30 stacked in a columnar fashion 130 may also be positioned in one course in a predetermined relation with blocks 30 in an adjacent course as the indexing 68 and stop surfaces 62, 64 of adjacent courses of blocks 30 are brought into registry with each other. Another predetermined relation for positioning the blocks 30 is a setback wall in which one block is offset a first predetermined distance from another such that the wall has a constant upwardly receding slope or batter. A third type of predetermined relation for positioning the blocks contemplated by the invention is a setback with a variable upwardly receding slope in which a plurality of predetermined distances is used to offset one block from another.

Blocks 30 stacked in a columnar fashion 130 of the present invention provide the advantage of allowing the viewable surface 34 of a horizontal block 30 to be positioned in a variety of predetermined relations to another viewable surface 34 of another block 30. Blocks 30 stacked in a columnar fashion 130 may be positioned in a coplanar relation to another viewable surface 34. A coplanar relationship between the viewable surfaces 34 of horizontal blocks 30 can be understood by modifying FIG. 8 such that the vertical block 90 is replaced by another horizontal block 30. Similarly, by replacing the vertical block 90 with another horizontal block 30 in FIGS. 6 and 7, one can appreciate two other types of viewable surface relations made possible by blocks 30 stacked in a columnar fashion 130. The distance between the viewable surface 34 of lower block 30 from the viewable surface 34 of the upper block 30 is shown by a first predetermined distance 16. Thirdly, in a setback retaining wall with columnar stacks 130, horizontal blocks 30 of the present invention may be offset from each other by a plurality of predetermined distances. A modification of FIG. 7 would show the difference between the two viewable surfaces 34 of the two horizontal blocks 30 as a predetermined distance 18.

Figure 12:
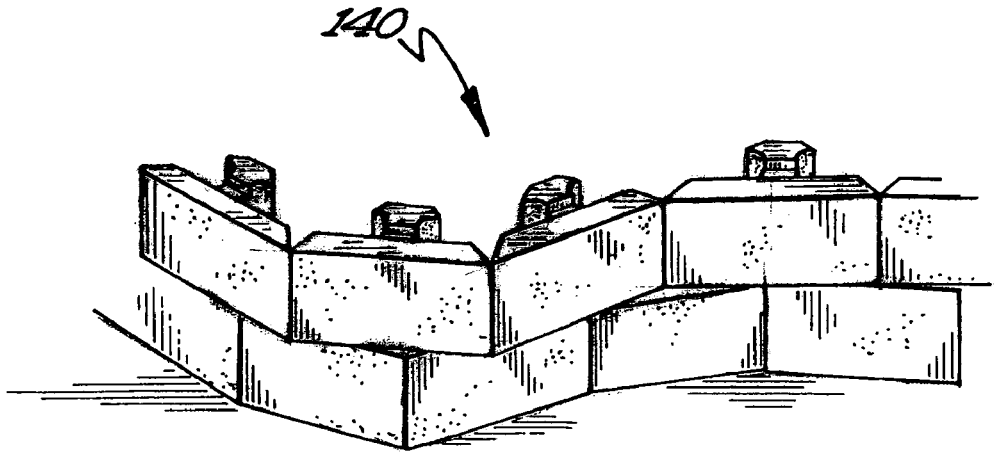
FIG. 12 is a front perspective view of an embodiment of a retaining wall with horizontal blocks stacked one above the other in a running bond fashion in accordance with the present invention.

FIG. 12 illustrates an embodiment of a running bond 140 type of stacked retaining wall of the present invention. The same advantages provided by the invention to a columnar stacked retaining wall 10 are also provided for a running bond 140 stack of horizontal blocks 30. The indexing 68 and stop surfaces 62, 64 may be used to position blocks 30 in one course into a predetermined relation with blocks 30 of an adjacent course. In a running bond 140 stack of blocks 30, the viewable surfaces 34 of the blocks 30 in one course may be positioned into a predetermined relation with blocks 30 of an adjacent course as the indexing 68 and stop surfaces 62, 64 of the adjacent course of blocks 30 are brought into registry with each other. Both the blocks 30, and the viewable surfaces 34 of the blocks 30, respectively, may be positioned in a predetermined relation with each other in a running bond 140 retaining wall 10. In a running bond 140 retaining wall 10, blocks with a plurality of predetermined distances may be positioned in a coplanar relation, a constant batter relation, or a variable batter relation.

A significant advantage to the present invention can be seen in FIG. 12 with a running bond 140 stacked retaining wall. A recess in preexisting blocks offered limited width, which consequently limited the placement options of the horizontal blocks 30 laterally along the course of the wall. The present invention recess 56 extends continuously and completely through the block 30. Now a block in a running bond pattern may be moved laterally as much as desired in either direction, providing more options and patterns.

The present invention having thus been described, other modifications, alterations or substitutions may present themselves to those skilled in the art, all of which are within the spirit and scope of the present invention. It is therefore intended that the present invention be limited in scope only by the claims attached below:

What is claimed is:

1. A preformed horizontally elongated block for use in a retaining wall, the preformed horizontally elongated block comprising:

a front portion, a rear portion, and a web portion connecting the front and rear portions, the front portion having first and second sides spaced apart by a first lateral dimension, a top surface, a bottom surface, a front surface and a back surface, the rear portion having first and second sides spaced apart by a second lateral dimension, a top surface and a bottom surface, wherein the second lateral dimension is less than the first lateral dimension, the web portion substantially solid with no cores and having a pair of side surfaces, a top and a bottom;

a single polyhedral projection extending outwardly from the top or bottom of the web portion, the projection including an indexing surface and presenting a first width dimension in a direction extending between the front portion and the rear portion of the block; and the block defining a recess opposite projection, the recess extending transversely and continuously across the block, the recess comprising a stop surface that is coplanar with the back surface of the front portion, wherein the recess of the horizontally elongated block presents a second width dimension in the direction extending between the front portion and the rear portion of the block, the second width dimension greater than the first width dimension so as to enable the indexing surface of the projection of a second block to engage the stop surface of the horizontally elongated block with no other portion of the projection of the second block contacting the horizontally elongated block.

2. The block of claim 1, wherein the indexing and stop surfaces of the horizontally elongated block are in vertical alignment with each other, and wherein the indexing and stop surfaces serve to position the block in one course in a predetermined relation with another block in an adjacent course as the indexing and stop surfaces of adjacent courses of blocks are brought into registry with each other.

3. The block of claim 1, wherein the indexing and stop surfaces of the horizontal block are offset from another block by a first predetermined distance with respect to the viewable surface of each block.

4. The block of claim 1, wherein the indexing and stop surfaces of the horizontal block are offset from another block by one of a plurality of predetermined distances with respect to the viewable surface of each block.

5. The block of claim 1, wherein the indexing and stop surfaces of an adjacent course of blocks serve to position the front surface of a block in one course of blocks in a predetermined relation with a block in an adjacent course as the indexing and stop surfaces of adjacent course of blocks are brought into registry with each other.

6. The block of claim 5, wherein the predetermined relation is coplanar.

7. The block of claim 5, wherein the predetermined relation is offset by a first predetermined distance.

8. The block of claim 5, wherein the predetermined relation is one of a plurality of predetermined distances.

9. The block of claim 1, wherein the viewable surface of the front member comprises a plurality of facets.

10. The block of claim 1, wherein the projection is generally rectangular.

11. The block of claim 1, wherein the projection is generally trapezoidal.

12. A preformed horizontally elongated block for use in a retaining wall, the preformed horizontally elongated block comprising:

a front member comprising a viewable surface, a rear surface, opposing sides, opposing top and bottom surfaces, wherein the front member has a lateral extent;

a rear member comprising an interior surface, an exterior surface, opposing sides, and opposing top and bottom surfaces, wherein the rear member has a lateral extent and wherein the lateral extent of the front member is greater than the lateral extent of the rear member;

a web connecting the front member to the rear member, the web substantially solid with no cores and having opposing sides, and opposing top and bottom surfaces; and a single polyhedral projection extending outwardly from at least a portion of the web, the projection including an indexing surface;

the web defining a recess on the opposite block top or bottom from the location of the projection, the recess extending transversely and continuously across the web, the recess defined by a stop surface that is coplanar with the back surface of the front member, wherein the recess of the horizontally elongated block is dimensioned so as to enable the indexing surface of the projection of a second block to engage the stop surface of the horizontally elongated block with no other portion of the projection of the second block contacting the horizontally elongated block.

13. The block of claim 12, wherein the projection is generally rectangular.

14. The block of claim 12, wherein the projection is generally trapezoidal.

15. A retaining wall comprising: a plurality of horizontal, preformed blocks, with each horizontal, preformed block being substantially solid with no cores and comprising a front, a rear, opposing sides, a top and a bottom, the front comprising a viewable surface and a back surface, with the plurality of horizontal, preformed blocks stacked one above the other; wherein each of the horizontal preformed blocks comprises: a single polyhedral projection extending outwardly from the block top or bottom, the projection presenting an indexing surface and presenting a first width dimension in a direction extending between the front portion and the rear portion of the block, each of the horizontal preformed blocks defining a recess on the opposite block top or bottom where the projection is located, the recess extending transversely across the block between the opposing sides, the recess comprising a stop surface that is coplanar with the rear surface of the front; with the projection and the recess extending vertically in the same direction relative to the block, and with the projection of each the horizontal preformed blocks arranged and configured to be received in the recess of the block in an adjacent course of blocks; and wherein the recess of the block presents a second width dimension in the direction extending between the front portion and the rear portion of the block, the second width dimension greater than the first width dimension so as to enable the indexing surface of the projection of a second block to engage the back surface of the front of the block with no other portion of the projection of the second block contacting the block, so as to thereby position the adjacent courses of blocks together in a predetermined relation.

16. The retaining wall of claim 15, wherein: the plurality of horizontal, preformed blocks are stacked one above the other in a columnar fashion with one block in one course positioned directly over another block in an underlying course.

17. The retaining wall of claim 15, wherein: the plurality of horizontal, preformed blocks are stacked one above the other in a running bond fashion with each block in one course overlapping the joint between a pair of blocks in an underlying course.

18. The retaining wall of claim 15, wherein the indexing and stop surfaces of each block are in vertical alignment with each other, and the indexing and stop surfaces serve to position blocks in one course in a predetermined relation with blocks in an adjacent course as the indexing and stop surfaces of adjacent courses of blocks are brought into registry with each other.

19. The retaining wall of claim 15, wherein the indexing and stop surfaces of each the horizontal blocks are offset from each other by a first predetermined distance with respect to the viewable surface of each block.

20. The retaining wall of claim 15, wherein the indexing and stop surfaces of each the horizontal blocks are offset from each other by one of a plurality of predetermined distances with respect to the viewable surface of each block.

21. The retaining wall of claim 15, wherein the indexing and stop surfaces of adjacent courses of blocks serve to position the viewable surfaces of blocks in one course in a predetermined relation with blocks in an adjacent course as the indexing and stop surfaces of adjacent course of blocks are brought into registry with each other.

22. The retaining wall of claim 21, wherein the predetermined relation is coplanar.

23. The retaining wall of claim 21, wherein the predetermined relation is offset by a first predetermined distance.

24. The retaining wall of claim 21, wherein the predetermined relation is one of a plurality of predetermined distances.

25. The retaining wall of claim 21, wherein the plurality of horizontal preformed blocks have different thicknesses.

26. The retaining wall of claim 21, wherein the plurality of horizontal preformed blocks have the same longitudinal extent.

27. The block of claim 15, wherein the projection is generally rectangular.

28. The block of claim 15, wherein the projection is generally trapezoidal.

29. A preformed concrete block for use in a retaining wall comprising:

a front portion, a rear portion, and a neck portion connecting the front and rear portions, the front, rear and neck portions all substantially solid with no cores therein, the front portion presenting a first lateral dimension and having a front surface, a back surface, a top surface and a bottom surface, the rear portion presenting a second lateral dimension, and having a front surface, a back surface, a top surface and a bottom surface, wherein the second lateral dimension is smaller than the first lateral dimension, the neck portion substantially solid with no cores and having a top surface and a bottom surface, the top surfaces of the front portion, rear portion and neck portion together defining a block top surface, the bottom surfaces of the front portion, back rear portion and web portion together defining a block bottom surface;

a single polyhedral projection extending outwardly from the block bottom surface, the projection including an indexing surface; and a recess defined in the block top surface opposite the projection, the recess extending transversely and continuously across the block, the recess partially defined by a stop surface extending laterally across the back surface of the front portion, wherein the recess of the block is dimensioned so as to enable the indexing surface of the projection of a second block to engage the stop surface of the block with no other portion of the projection of the second block contacting the block.

* * * * *